US008853969B1

(12) United States Patent
Chen et al.

(10) Patent No.: US 8,853,969 B1
(45) Date of Patent: Oct. 7, 2014

(54) LIGHT EMITTING ELEMENT DRIVE DEVICE

(71) Applicant: Anpec Electronics Corporation, Hsinchu (TW)

(72) Inventors: Chih-Yuan Chen, Hsinchu (TW); Liang-Hsiang Chiu, Hsinchu (TW)

(73) Assignee: Anpec Electronics Corporation, Hsinchu (TW)

( * ) Notice: Subject to any disclaimer, the term of this patent is extended or adjusted under 35 U.S.C. 154(b) by 0 days.

(21) Appl. No.: 14/023,729

(22) Filed: Sep. 11, 2013

(30) Foreign Application Priority Data

Jun. 21, 2013 (TW) ..... 102122137 A

(51) Int. Cl.
*H05B 37/02* (2006.01)

(52) U.S. Cl.
CPC ..... *H05B 37/02* (2013.01)
USPC ..... 315/308; 315/291; 315/312

(58) Field of Classification Search
USPC ..... 315/209 R, 224–226, 291, 294, 307, 315/308, 312
See application file for complete search history.

(56) References Cited

U.S. PATENT DOCUMENTS 8,653,756 B2 * 2/2014 Szczeszynski et al. ..... 315/308

* cited by examiner

*Primary Examiner* — Jimmy Vu
(74) *Attorney, Agent, or Firm* — Rosenberg, Klein & Lee

(57) ABSTRACT

The present disclosure provides a light emitting element drive device for driving a plurality of LED strings. The device comprises a power supply circuit, a plurality of current sources, a plurality of error amplifiers, a plurality of first diodes and a control circuit. The power supply circuit provides a driving voltage to each of the LED strings. The inverted input terminal of each error amplifier is coupled to a second terminal of the corresponding LED string. Each error amplifier output the voltage difference between the second terminal of the corresponding LED string and a first reference voltage. The anode of each first diode is coupled to the output terminal of the corresponding error amplifier, and the cathodes of the diodes are coupled to each other. The control circuit adjusts the driving voltage of the power supply circuit according to the cathode voltage of the conducted first diode.

10 Claims, 3 Drawing Sheets

LIGHT EMITTING ELEMENT DRIVE DEVICE

BACKGROUND OF THE INVENTION

1. Field of the Invention

The instant disclosure relates to a drive device; in particular, to a light emitting element drive device.

2. Description of Related Art

Light-emitting element, such as a light-emitting diode (LED), could be utilized as a back light source of the display as well as a display element. The brightness of the LED could be increased due to increasing of the current flowing through the LED. A plurality of light-emitting strings with the same current in each light-emitting string could be applied to provide a uniform light source.

Usually, the light-emitting string is composed of a plurality of light-emitting elements (e.g. LEDs) which are serially connected. A terminal of the light-emitting string receives a driving voltage and another terminal of the light-emitting string is coupled to a current source. When the conducting voltages of the light-emitting strings are the same, each of the same current sources could be utilized to provide the same current to each of the light-emitting strings, such that each light-emitting string could emit light with the same brightness.

However, the light-emitting elements with the same design may have different conducting voltages due to the process variation of manufacture, thus each light-emitting string may have different conducting voltage. Depending on the existing technology, the light-emitting strings for the back light source are coupled to the same driving voltage, in which the light-emitting string with larger conducting voltage may cause the voltage at the terminal of the light-emitting string which is coupling to the corresponding current source to be too low, such that the corresponding current source would not operate normally.

SUMMARY OF THE INVENTION

The object of the instant disclosure is to offer a light-emitting element drive device which makes a plurality of light-emitting strings have the same conducting current.

In order to achieve the aforementioned objects, according to an embodiment of the instant disclosure, a light-emitting element drive device is provided. The light-emitting element drive device is for driving a plurality of light-emitting strings. Each light-emitting string comprises at least a light-emitting element, and each light-emitting string has a first terminal and a second terminal. The light-emitting element drive device comprises a power supply circuit, a plurality of current sources, a plurality of error amplifiers, a plurality of first diodes and a control circuit. The power supply circuit provides a driving voltage to the first terminal of each light-emitting string. The plurality of current sources is corresponding to the plurality of light-emitting strings respectively, and each current source is coupled to the second terminal of the corresponding light-emitting string. The plurality of error amplifiers is corresponding to the plurality of light-emitting strings respectively. The inverted input terminal of the error amplifier is coupled to the second terminal of the corresponding light-emitting string. The non-inverted input terminal of the error amplifier receives a first reference voltage. Each error amplifier amplifies and outputs the voltage difference between the voltage of the second terminal and the first reference voltage. The plurality of first diodes is corresponding to the plurality of error amplifiers respectively.

The anode of each first diode is coupled to the output terminal of the corresponding error amplifier. The cathodes of the first diodes are coupled to each other. The first diode corresponding to the error amplifier with larger output voltage is conducting (ON) and the rest of the first diodes are cut-off (OFF). The voltage at the cathodes of the first diodes is a detecting voltage. The control circuit controls the driving voltage of the power supply circuit, and receives the detecting voltage. The control circuit compares the detecting voltage and a reference value to adjust the driving voltage of the power supply circuit, so as to make the current sources provide equal current to the light-emitting strings.

In summary, a light-emitting element drive device is offered. The error amplifier provides the voltage between the voltage of the second terminal of the light-emitting string and the first reference voltage to the anode of the first diode. The lower voltage (of the second terminal of the light-emitting string) generated by the light-emitting string with larger conducting voltage is converted to a detecting signal through the parallel connected diodes. Thus, the control circuit could adjust the driving voltage generated by the power supply circuit according to the detecting signal.

In order to further the understanding regarding the instant disclosure, the following embodiments are provided along with illustrations to facilitate the disclosure of the instant disclosure.

DETAILED DESCRIPTION OF THE PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings.

Figure 1:
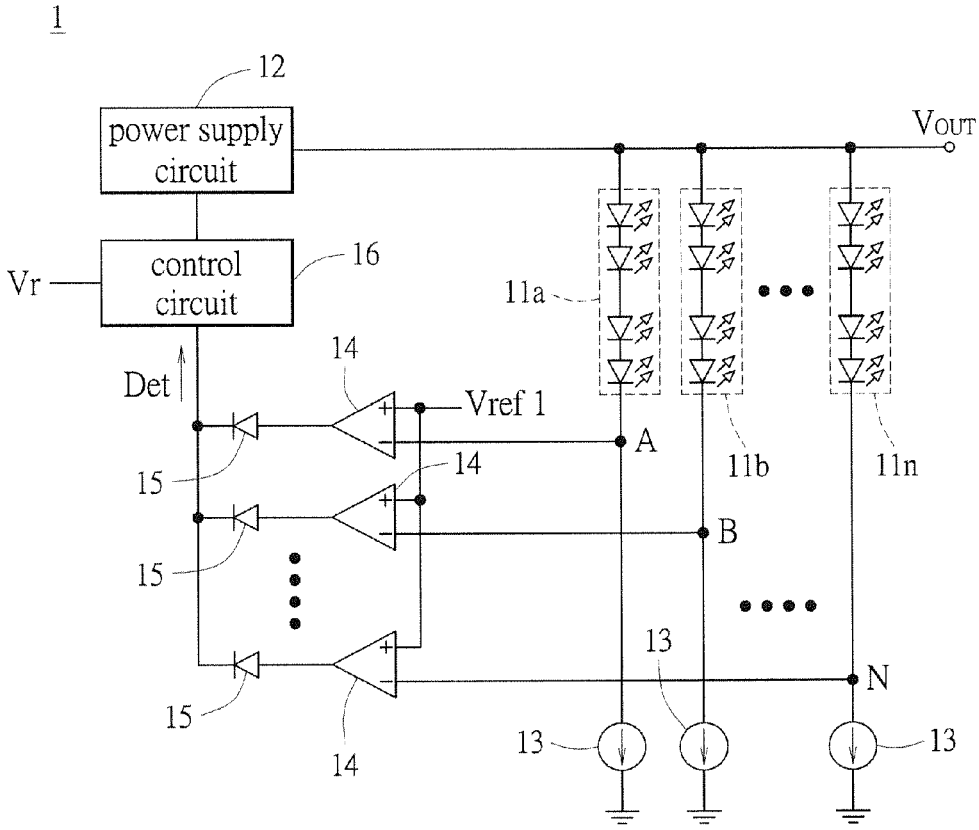
FIG. 1 shows a circuit diagram of a light-emitting element drive device according to an embodiment of the instant disclosure.

Please refer to FIG. 1 showing a circuit diagram of a light-emitting element drive device according to an embodiment of the instant disclosure. The light-emitting element drive device 1 is for driving a plurality of light-emitting strings 11*a*, 11*b* . . . and 11*n*. Each light-emitting string (11*a*, 11*b* . . . or 11*n*) comprises at least a light-emitting element, and each light-emitting string (11*a*, 11*b* . . . or 11*n*) has a first terminal and a second terminal. The light-emitting element may be a light-emitting diode (LED). In this embodiment, there are N light-emitting strings, in which N is a positive integer, and each light-emitting string has four serially connected LEDs, as shown in FIG. 1. However, the number of the light-emitting strings and the number of the light-emitting elements in each light-emitting string are not intended to limit the scope of the present disclosure. The light-emitting element drive device 1 comprises a power supply circuit 12, a plurality of current sources 13, a plurality of error amplifiers 14, a plurality of first diodes 15 and a control circuit 16.

The power supply circuit 12 provides a driving voltage $V_{OUT}$ to the first terminal of each light-emitting string (11*a*,

11*b* . . . or 11*n*). The plurality of current sources 13 is corresponding to the plurality of light-emitting strings 11*a*, 11*b* . . . and 11*n* respectively, and each current source 13 is coupled to the second terminal of the corresponding light-emitting string (11*a*, 11*b* . . . or 11*n*). The plurality of error amplifiers 14 is corresponding to the plurality of light-emitting strings 11*a*, 11*b* . . . and 11*n* respectively. The inverted input terminal of the error amplifier 14 is coupled to the second terminal of the corresponding light-emitting string (11*a*, 11*b* or 11*n*). The non-inverted input terminal of the error amplifier 14 receives a first reference voltage Vref1. Each error amplifier 14 amplifies and outputs the voltage difference between the voltage of the second terminal and the first reference voltage Vref1. The plurality of first diodes 15 is corresponding to the plurality of error amplifiers 14 respectively. The anode of each first diode 15 is coupled to the output terminal of the corresponding error amplifier 14. The cathodes of the first diodes 15 are coupled to each other.

The first diode 15 corresponding to the error amplifier 14 with larger output voltage is conducting (ON) and the rest of the first diodes 15 are cut-off (OFF). The voltage at the cathodes of the first diodes 15 is a detecting voltage Det. The control circuit 16 controls the driving voltage $V_{OUT}$ of the power supply circuit 12, and receives the detecting voltage Det. The control circuit 16 compares the detecting voltage Det and a reference value Vr to adjust the driving voltage $V_{OUT}$ of the power supply circuit 12, so as to make the current sources 13 provide equal current to the light-emitting strings 11*a*, 11*b* . . . and 11*n*. For example, the control circuit 16 increases the driving voltage $V_{OUT}$ when the detecting voltage Det is lower than the reference value Vr.

More specifically, although the conducting voltage of each of the light-emitting strings 11*a*, 11*b* . . . and 11*n* are design to the same desire value Vd, the second terminal A, B . . . and N of the manufactured light-emitting strings 11*a*, 11*b* . . . and 11*n* may be quite different due to process variation. Meanwhile, the first reference Vref1 may be design to be larger than the desire value Vd which is the driving voltage $V_{OUT}$ minus the conducting voltage of the light-emitting strings 11*a*, 11*b* . . . and 11*n*, thus Vref1>$V_{OUT}$−Vd. Or, while considering the process variation, the first reference voltage Vref1 may be larger than $V_{OUT}$−(Vd+ΔV) in which ΔV is the variation of the conducting voltage of the light-emitting strings 11*a*, 11*b* . . . and 11*n* due to process variation. However, the present disclosure does not limit the value of the first reference voltage Vref1. The first reference voltage Vref1 can be determined arbitrarily as needed, as long as the first reference voltage Vref1 is always larger than the voltage of the second terminal of the light-emitting strings 11*a*, 11*b* . . . and 11*n*.

Therefore, the output voltage of the e Tor amplifier 14 varies according to the conducting voltage of the corresponding light-emitting strings 11*a*, 11*b* . . . and 11*n*. For example, the voltage of the second terminal A, B . . . or N of the light-emitting strings 11*a*, 11*b* . . . or 11*n* with larger conducting voltage would be lower. Meanwhile, the second terminal A, B . . . or N with the lowest voltage would cause the output voltage of the corresponding error amplifier 14 to output the largest voltage. The diode 15 coupling with the error amplifier 14 with the largest output voltage would be conducting (ON), and the rest of the diodes 15 coupling with the error amplifiers 14 with lower output voltage would be cut-off (OFF), such that the voltage level of the cathodes of the diodes 15 would be the same. The detecting voltage Det can be obtained by deducting the conducting voltage of the diode 15 (which may be neglected) from the output voltage of the error amplifier 14 with the largest voltage. It is worth mentioning that the connection relationship between the plurality of error amplifiers and the plurality of diodes is not for restricting the scope of the present invention. For the same efficacy of the operation, the connection between the error amplifiers and the diodes can be realized in different configurations. Additionally, the error amplifiers and the diodes may also be realized by other circuit components.

Figure 2:
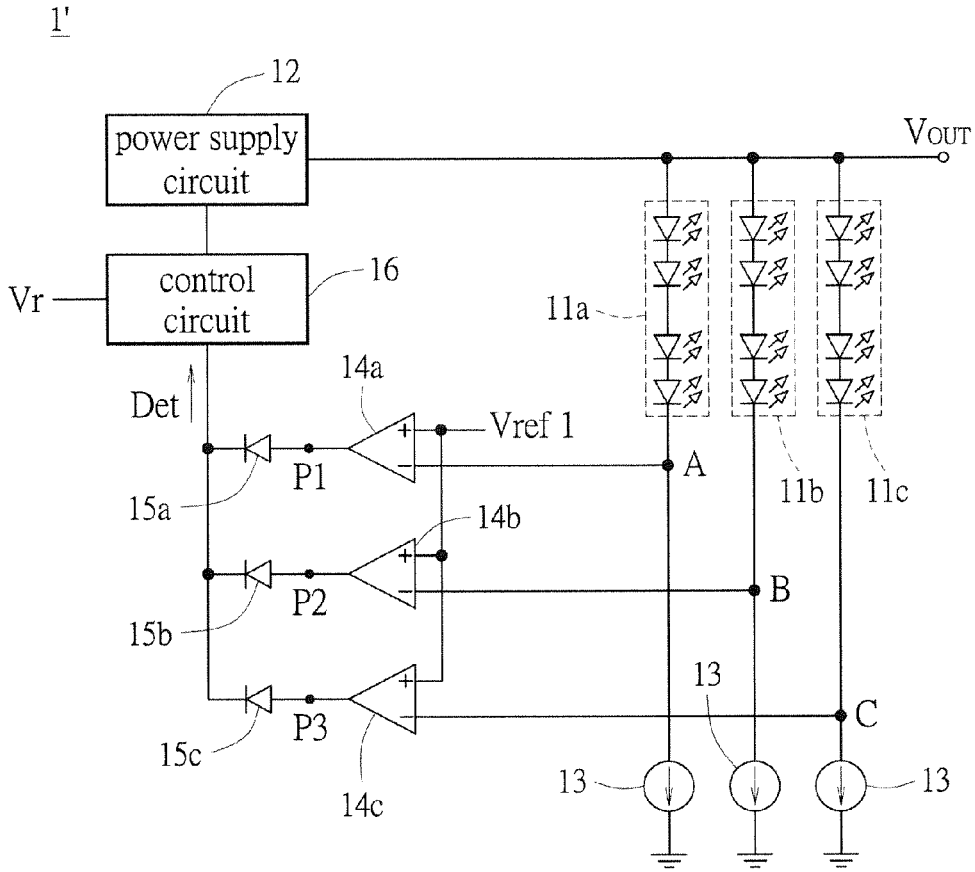
FIG. 2 shows a circuit diagram of a light-emitting element drive device according to another embodiment of the instant disclosure.

Referring to FIG. 2 showing a circuit diagram of a light-emitting element drive device according to another embodiment of the instant disclosure. For ease of description for the generating manner of the detecting voltage Det, the light-emitting element drive device 1' shown in FIG. 2 is coupled to three light-emitting strings 11*a*, 11*b* and 11*n*. Similar to the embodiment shown in FIG. 1, the number of the current source 13, the number of the error amplifier and the number of the first diode in the light-emitting element drive device 1' are both three. Each current source 13, each error amplifier 14*a*, 14*b* or 14*c*, and each first diode 15*a*, 15*b* or 15*c* are corresponding to each light-emitting string 11*a*, 11*b* or 11*n* respectively. The configuration of the light-emitting element drive device 1' is similar to that of the embodiment shown in FIG. 1, thus the redundant information is not repeated.

Here, description will be given on assumption that the voltage at the nodes A, B and C (the second terminals of the light-emitting strings 11*a*, 11*b* and 11*c*) for normal operation of the current sources 13 is 0.4 volt (V). The voltage of the nodes A, B and C may be 0.5V, 1V and 2V respectively due to process variation. In this embodiment, the process variation causes the difference of the conducting voltage of the light-emitting strings 11*a*, 11*b* and 11*n* to be as large as 1.5V. Meanwhile, the voltage of the output terminal P1 of the error amplifier 14*a* is larger than the voltage of output terminal P2 of the error amplifier 14*b*, and the voltage of the output terminal P2 of the error amplifier 14*b* is larger than the voltage of the output terminal P3 of the error amplifier 14*c*. In this case, the diode 15*a* would be conducting (ON), and the diodes 15*b* and 15*c* would be cut-off (OFF). Thus, the error amplifier corresponding to the light-emitting string having the largest conducting voltage would outputs the largest output voltage. And, the corresponding diode would be conducting. The voltage level of the cathode of the conducted diode is representing the detecting voltage, and the voltage level of the cathodes of the rest diodes is the same as to the voltage of the cathode of the conducted diode. It can be seen the detecting voltage Det would vary according to the conducting voltage of the light-emitting strings, and the detecting voltage Det reflects the largest conducting voltage among the light-emitting strings.

When the detecting voltage Det is lower than the reference value Vr, the control circuit 16 may increase the driving voltage VOUT of the power supply circuit to avoid the abnormal operation of the current sources 13 caused by the low voltage (e.g. lower than 0.4V) at the node A, B or C.

Figure 3:
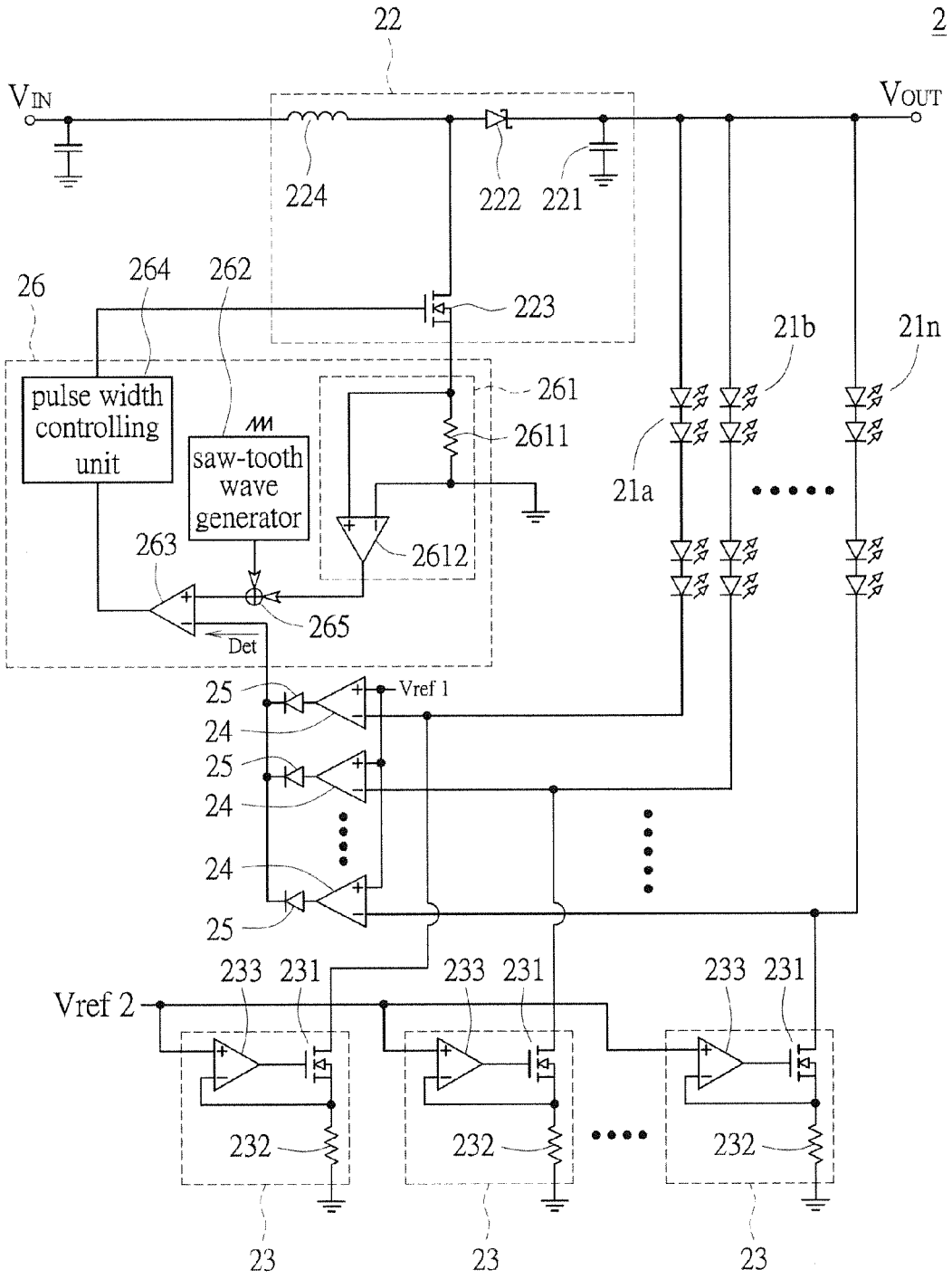
FIG. 3 shows a detailed circuit diagram of a light-emitting element drive device according to another embodiment of the instant disclosure.

Referring to FIG. 3 showing a detailed circuit diagram of a light-emitting element drive device according to another embodiment of the instant disclosure. The light-emitting element drive device 2 comprises a power supply circuit 22, a plurality of current sources 23, a plurality of error amplifiers 24, a plurality of first diodes 25 and a control circuit 26. The connections between the power supply circuit 22, the plurality of current sources 23, the plurality of error amplifiers 24, the plurality of first diodes 25 and the control circuit 26 are the same as to the connections of the embodiment shown in FIG. 1. Detailed description for the power supply circuit 22, current sources 23 and the control circuit 26 are disclosed in the follows.

In this embodiment, the power supply circuit 22 is a step up converter; however, this shouldn't be the limitation to the present invention. The step up converter (power supply circuit 22) has an output terminal, and the output terminal provides the driving voltage $V_{OUT}$. The step up converter comprises a capacitor 221, a second diode 222, an electronic switch 223 and an inductor 24. The capacitor 221 is coupled between the output terminal and a ground terminal (GND). The cathode of the second diode 222 is coupled to the output terminal, and the second diode 222 may be a zener diode, but the present invention is not so restricted. The electronic switch 223 is coupled between the anode of the second diode 222 and the ground terminal (GND). In this embodiment, the electronic switch 223 is a MOSFET, but the present invention is not so restricted. The inductor 224 coupled between an input voltage $V_{IN}$ and the anode of the second diode 222. The driving voltage $V_{OUT}$ could be adjusted by controlling the conducting status (ON/OFF) of the electronic switch 223. An artisan of ordinary skill in the art will appreciate how to employ the step up converter.

Referring to FIG. 3 again. The current source 23 is a voltage to current source. The current source 23 comprises a transistor 231, a resistor 232 and an operational amplifier 233. The transistor 231 has a first terminal, a second terminal and a control terminal. The first terminal of the transistor 231 is coupled to the second terminal of the light-emitting string. The resistor 232 is coupled between the second terminal of the transistor and a grounding terminal (GND). The output terminal of the operational amplifier 233 is coupled to the control terminal of the transistor 231. The inverted input terminal of the operational amplifier 233 is coupled to the second terminal of the transistor 231. The non-inverted input terminal of the operational amplifier 233 receives a second reference voltage Vref2. The current source 23 shown in FIG. 3 is for illustration but not for restricting the scope of the present invention.

Referring to FIG. 3 again. The control circuit 26 is a pulse width modulator. The control circuit 26 comprises a current sensing unit 261, a saw-tooth wave generator 262, an adder 265, a comparator 263 and a pulse width controlling unit 264. The current sensing unit 261 is coupled to the electronic switch 223, and detects the current flowing through the electronic switch 223 and generating a current signal. The saw-tooth wave generator 262 generates a saw-tooth wave signal. The adder 265 adds the current signal and the saw-tooth wave signal to obtain a feedback voltage. The negative input terminal of the comparator 263 receives the detecting voltage Det. The positive input terminal of the comparator 263 receives the feedback voltage. The mentioned feedback voltage is the reference value Vr shown in FIG. 1. The pulse width controlling unit 264 is coupled to the output terminal of the comparator 263, and controls the operating status (ON/OFF) of the electronic switch 223 of the step up converter (power supply circuit 22) according to the comparing result of the comparator 263. When the detecting voltage Det is lower than the reference value Vr, the control circuit 26 increases the driving voltage $V_{OUT}$ of the power supply circuit 22 by increasing the conduction time of the electronic switch 223.

The current sensing unit 261 is a feedback mechanism of the pulse width modulator. The current sensing unit 261 comprises a resistor 2611 and an amplifier 2612 (which may be an error amplifier). The resistor 2611 is coupled between the electronic switch 223 of the step up converter and the grounding terminal (GND). The inverted input terminal and the non-inverted input terminal of the amplifier 2612 are coupled to two ends of the resistor 2611 respectively. It is worth mentioning that the current sensing unit 261 may be replaced by a voltage sensor, which is for sensing the driving voltage $V_{OUT}$ for example. The method of generating the reference value Vr is not restricted to the aforementioned circuit.

According to above descriptions, a light-emitting element drive device is offered. The error amplifier provides the voltage between the voltage of the second terminal of the light-emitting string and the first reference voltage to the anode of the first diode. The lower voltage (of the second terminal of the light-emitting string) generated by the light-emitting string with larger conducting voltage is converted to a detecting signal through the parallel connected diodes. Thus, the control circuit could adjust the driving voltage generated by the power supply circuit according to the detecting signal. Accordingly, each of the light-emitting strings may have the same conducting current, so as to make the light emitted by each of the light-emitting strings have the same brightness.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A light-emitting element drive device for driving a plurality of light-emitting strings, each light-emitting string comprising at least a light-emitting element, each light-emitting string having a first terminal and a second terminal, the light-emitting element drive device comprising:

a power supply circuit, providing a driving voltage to the first terminal of each light-emitting string;

a plurality of current sources, corresponding to the plurality of light-emitting strings respectively, each current source coupled to the second terminal of the corresponding light-emitting string;

a plurality of error amplifiers, corresponding to the plurality of light-emitting strings respectively, the inverted input terminal of the error amplifier coupled to the second terminal of the corresponding light-emitting string, the non-inverted input terminal of the error amplifier receiving a first reference voltage, each error amplifier amplifying and outputting the voltage difference between the voltage of the second terminal and the first reference voltage;

a plurality of first diodes, corresponding to the plurality of error amplifiers respectively, the anode of each first diode coupled to the output terminal of the corresponding error amplifier, the cathodes of the first diodes coupled to each other, wherein the first diode corresponding to the error amplifier with larger output voltage is conducting (ON) and the rest of the first diodes are cut-off (OFF), the voltage at the cathodes of the first diodes is a detecting voltage; and a control circuit, controlling the driving voltage of the power supply circuit, and receiving the detecting voltage, wherein the control circuit compares the detecting voltage and a reference value to adjust the driving voltage of the power supply circuit, so as to make the current sources provide equal current to the light-emitting strings.

2. The light-emitting element drive device according to claim 1, wherein the power supply circuit is a step up converter.

3. The light-emitting element drive device according to claim 2, wherein the control circuit increases the driving voltage of the power supply circuit when the detecting voltage is lower than the reference value.

4. The light-emitting element drive device according to claim 2, wherein the step up converter has an output terminal, the output terminal provides the driving voltage, the step up converter comprises:

a capacitor, coupled between the output terminal and a ground terminal;

a second diode, the cathode of the second diode coupled to the output terminal;

an electronic switch, coupled between the anode of the second diode and the ground terminal; and an inductor, coupled between an input voltage and the anode of the second diode.

5. The light-emitting element drive device according to claim 4, wherein the control circuit comprising:

a current sensing unit, coupled to the electronic switch, detecting the current flowing through the electronic switch and generating a current signal;

a saw-tooth wave generator, generating a saw-tooth wave signal;

an adder, adding the current signal and the saw-tooth wave signal to obtain a feedback voltage;

a comparator, the negative input terminal of the comparator receiving the detecting voltage, the positive input terminal of the comparator receiving the feedback voltage; and a pulse width controlling unit, coupled to the output terminal of the comparator, controlling the operating status (on/off) of the electronic switch according to the comparing result of the comparator.

6. The light-emitting element drive device according to claim 4, wherein the electronic switch is a MOSFET.

7. The light-emitting element drive device according to claim 5, wherein the current sensing unit comprises:

a resistor, coupled between the electronic switch of the step up converter and the grounding terminal; and an amplifier, the inverted input terminal and the non-inverted input terminal of the amplifier coupled to two ends of the resistor respectively.

8. The light-emitting element drive device according to claim 1, wherein the light-emitting element is a light-emitting diode (LED).

9. The light-emitting element drive device according to claim 1, wherein the control circuit is a pulse width modulator.

10. The light-emitting element drive device according to claim 1, wherein the current source comprises:

a transistor, having a first terminal, a second terminal and a control terminal, the first terminal of the transistor coupled to the second terminal of the light-emitting string;

a resistor, coupled between the second terminal of the transistor and a grounding terminal; and an operational amplifier, the output terminal of the operational amplifier coupled to the control terminal of the transistor, the inverted input terminal of the operational amplifier coupled to the second terminal of the transistor, the non-inverted input terminal of the operational amplifier receiving a second reference voltage.

* * * * *